US006659302B2

(12) United States Patent
Lin

(10) Patent No.: US 6,659,302 B2
(45) Date of Patent: Dec. 9, 2003

(54) LEAK PROOF COFFEE MUG LID

(76) Inventor: Shin-Shuoh Lin, 27022 Falling Leaf Dr., Laguna Hills, CA (US) 92653

( * ) Notice: Subject to any disclaimer, the term of this patent is extended or adjusted under 35 U.S.C. 154(b) by 61 days.

(21) Appl. No.: 10/143,912

(22) Filed: May 13, 2002

(65) Prior Publication Data

US 2003/0209547 A1 Nov. 13, 2003

(51) Int. Cl.[7] ..... B65D 51/18

(52) U.S. Cl. ..... 220/254.8; 280/715; 222/509

(58) Field of Search ..... 220/254.8, 254.3, 220/255, 259.5, 714, 745, 367.1, 369, 373, 715, 719, 203.05, 203.06, 213; 215/11.5, 17, 28; 222/509, 507, 511, 516, 512

(56) References Cited

U.S. PATENT DOCUMENTS

| | | | | | |
|---|---|---|---|---|---|
| 2,608,841 | A | * | 9/1952 | Rice | 215/309 |
| 3,727,808 | A | * | 4/1973 | Fitzgerald | 222/482 |
| 4,276,992 | A | * | 7/1981 | Susich | 220/254.5 |
| 4,303,173 | A | * | 12/1981 | Nergard | 220/254.5 |
| 4,712,704 | A | * | 12/1987 | Ramsey et al. | 220/254.4 |
| 4,754,888 | A | | 7/1988 | Letch et al. | |
| 5,118,014 | A | * | 6/1992 | Hestehave et al. | 222/472 |
| 5,148,936 | A | * | 9/1992 | DeGrow | 220/254.3 |
| 5,186,353 | A | * | 2/1993 | Ramsey | 220/711 |
| 5,249,703 | A | | 10/1993 | Karp | |
| 5,294,014 | A | * | 3/1994 | Wyatt et al. | 220/253 |
| D346,933 | S | | 5/1994 | Denny et al. | |
| D362,156 | S | | 9/1995 | Goto et al. | |
| D362,369 | S | | 9/1995 | Bridges | |
| 5,472,121 | A | * | 12/1995 | Silano | 222/158 |
| D373,051 | S | | 8/1996 | Kramer et al. | |
| D386,948 | S | | 12/1997 | Wissinger | |
| D396,777 | S | | 8/1998 | Inoue | |
| D398,187 | S | | 9/1998 | Parker | |
| D411,713 | S | | 6/1999 | Bridges | |
| 5,918,761 | A | | 7/1999 | Wissinger | |
| D416,757 | S | | 11/1999 | Ginuntoli | |
| D425,758 | S | | 5/2000 | Freed | |
| 6,468,332 | B2 | * | 10/2002 | Goglio et al. | 96/134 |

* cited by examiner

*Primary Examiner*—Nathan J. Newhouse
*Assistant Examiner*—Lien Tm Ngo
(74) *Attorney, Agent, or Firm*—Gordon K. Anderson

(57) ABSTRACT

A leak proof coffee mug lid (20) is taught that utilizes a lid body (22) with a aperture (24) in the middle, which includes valve positioning indexing shoulders (26). The body has a number of outlet ports (28) for dispensing coffee or liquid. A valve guide plate (42) is disposed within the aperture which includes an upwardly protruding push ring (54) and a gasketed valve plate (52) that is slideably positioned within the push ring. A spring loaded twist knob (64) is rotatably located within a top portion of the aperture. When the twist knob is rotated, within the indexing shoulders, the valve plate is urged downwardly, disengaging the valve plate from the lid body creating a flow path around the valve plate and through the outlet ports. This flow path permits coffee to be supplied to the user at any orientation around the lid. When the twist knob is rotatably reversed, the valve plate returns to its at rest position, under spring compression, securing the liquid in a leak proof manner within the mug.

19 Claims, 3 Drawing Sheets

2/3

LEAK PROOF COFFEE MUG LID

TECHNICAL FIELD

The present invention relates to coffee mug lids in general. More specifically to a lid that has a spring loaded, gasketed valve that opens when a finger twist knob is rotated permitting coffee to be released from the mug and sealed when rotated in reverse.

BACKGROUND ART

Previously, many types of lids have been used in endeavoring to provide an effective means to enclose a coffee mug or cup. In the past coffee mugs and cups are normally sealed by the use of a resilient cover that snaps over a rim on the top and must be manually removed and replaced. Some mugs have lids that include some type of valve or release mechanism permitting the user to seal the mug when not in use.

A the prior art listed below did not disclose any patents that possess any of the novelty of the instant invention, however the following U.S. patents are considered related:

| Patent Number | Inventor | Issue Date |
|---|---|---|
| Des. 346,933 | Denny et al. | May. 17, 1994 |
| Des. 362,156 | Goto et al. | Sep. 12, 1995 |
| Des. 362,369 | Bridges | Sep. 19, 1995 |
| Des. 373,051 | Kramer et al. | Aug. 27, 1996 |
| Des. 386,948 | Wissinger | Dec. 02, 1997 |
| Des. 396,777 | Inoue | Aug. 11, 1998 |
| Des. 398,187 | Parker | Sep. 15, 1998 |
| Des. 411,713 | Bridges | Jun. 29, 1999 |
| Des. 416,757 | Ginuntoli | Nov. 23, 1999 |
| Des. 425,758 | Freed | May. 30, 2000 |
| 4,754,888 | Letsch et al. | Jul. 05, 1988 |
| 5,249,703 | Karp | Sep. 05, 1993 |
| 5,918,761 | Wissinger | Jul. 06, 1999 |

Letsch et al. in U.S. Pat. No. 4,754,888 discloses a carafe with an inner container surrounded by a casing. The inner container and the casing have an opening at the top which may be closed by a separate plug. The plug and opening in the container and casing are shaped such that it is possible to fill or empty the inner container while the plug is still in the opening. The plug and container both have mating grooves that provide opposed flow paths into and out of the container. The container also includes a basin around the top for receiving coffee from a coffee maker and the plug has openings to provide a flow path from the basin into the container interior.

Karp in U.S. Pat. No. 5,249,703 teaches a travel mug that includes a container and a lid in combination. The container has a handle and an annular lip that has an annulus capable of forming a seal with the top side of the annular lip. A cylindrical well in the lid has a vertical dividing wall such that the lid may be readily rotated by hand. The retaining arms extend from the underside of the lid and engage the underside of the annular lip to pull it into tight abutment. Diametrically opposed gaps in the lip act as passageway for the retaining arms. Similarly diametrically opposed notches in the lid align with the gaps to allow liquid to be poured from the container.

U.S. Pat. No. 5,918,761 issued to Wissinger is for an insulated container and cover combination that has an outer container shell terminating at an opening with a surrounding edge. An inner container shell is nested within the outer container shell and has an opening surrounded by a continuous edges in abutment with the surrounding edge. The inner container shell is spaced inwardly and is out of contact with the outer shell. A cover mounting assembly is attached to the outer shell adjacent to the opening. A single seal, made of elastomeric material, has a sealing surface disposed at the interface of the shells. Locating rings define the removable cover mounting assembly and locate the single sealing ring on the inner and outer shells.

For background purposes and as indicative of the art to which the invention is related reference may be made to the remaining cited design patents.

DISCLOSURE OF THE INVENTION

Many types of mug lids are in common use today particularly with the wide acceptance of stainless steel and dual wall plastic mugs in a myriad of configurations. Liquids such as coffee, tea and hot chocolate etc. are often carried in mugs throughout the day and even when traveling in vehicles. Song with the difficulty of keeping the liquid hot, spillage is probably the larger obstacle to overcome.

It is therefore a primary object of the invention to provide the public with a lid that is continually, sealed until manually opened by a deliberate act of twisting a finger knob. This invention provides a liquid tight seal, under spring pressure, with a gasket continually forced onto a valve seat such that if the mug is inadvertently tipped over no liquid will be released from the mug. There are many other types of lids available in today's market that have openings with covers but if tipped over, particularly if they remain horizontal, have a tendency to leak and spill coffee or other staining liquids onto the surface. Most lids in this category have sliding valves that are operated by hand or small caps that hinge out of the way however true liquid tight seals are uncommon or require extensive manual manipulation to accomplish such a union.

An important object of the invention is that it is easy to understand its operation as one simply rotates the finger twist knob in a clock wise direction and the lid opens and stays open until it is twisted in the reverse direction when the lid automatically reverts to its normally closed and sealed position with the spring tension assuring a tight seal. Indicia located on the top of the dome indicate the position of the valve in a universal manner with symbols or written words in the language used.

Another object of the invention is that the mug may be used in any orientation, that is to say, once the valve is opened the mug may be turned in any direction relative to the handle and the coffee or liquid is always available around the lip. This object is realized by the use of a series of outlet ports completely around the raised lip of the lid. The liquid always remains level therefore if the mug is tipped in the drinking attitude the liquid will flow from the appropriate set of ports regardless of where the handle is positioned.

Yet another object of the invention is its ability to be cleaned easily. Cleaning is particularly simple as the lid may be emerged in water and cleaning inside is a simple matter of allowing the water to dissolve the residue inside. The valve may be open or closed during this cleaning procedure however it is more thorough if the lid is in the open position as the interface of the gasket to the lid body seat would be cleaned. The compression spring is fabricated of stainless steel and the balance of the lid is thermoplastic which will not rust or deteriorate.

Still another object of the invention is that it has few moving parts which interface with each other and the material has ample structural integrity to eliminate breakage and undue wear.

A final object of the invention is that it easy to manufacture since few parts are used and it is not difficult to assemble making it cost effective to produce.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
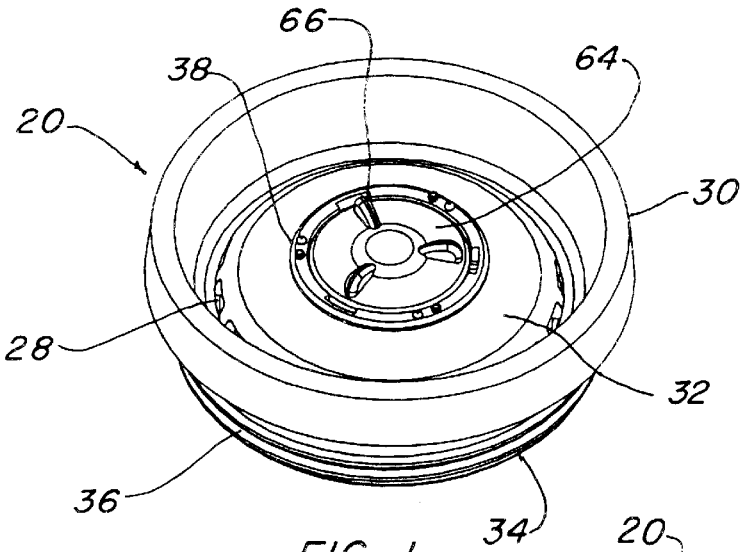
FIG. 1 is a partial isometric view of the preferred embodiment.
Figure 2:
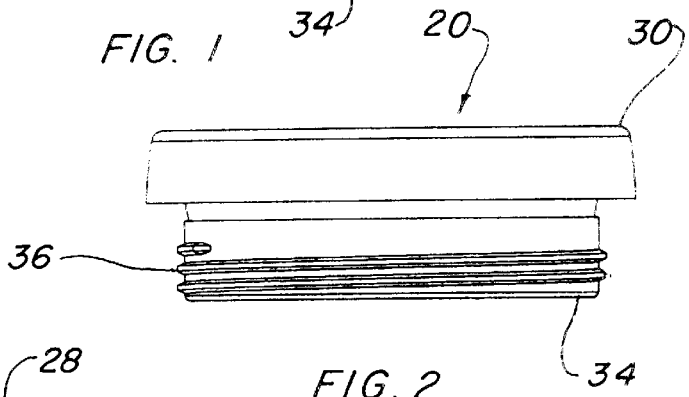
FIG. 2 is a side elevation view of the preferred embodiment.
Figure 3:
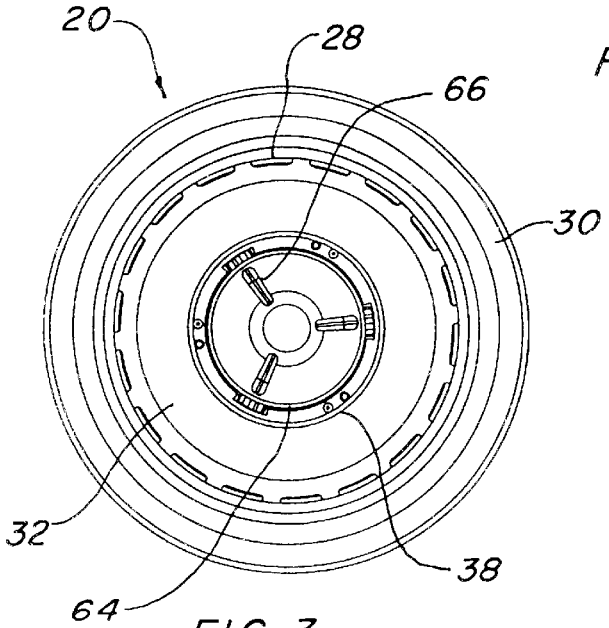
FIG. 3 is a top elevation view of the preferred embodiment.
Figure 4:
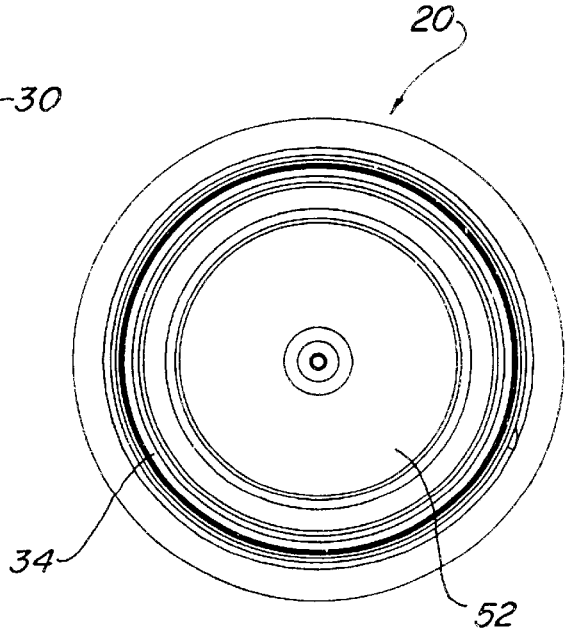
FIG. 4 is a bottom view of the preferred embodiment.

The best mode for carrying out the invention is presented in terms of a preferred embodiment. This preferred embodiment is shown in FIGS. 1 thorough 13 with the coffee mug lid 20 comprising a lid body 22 that has a centralize aperture 24 therethrough. The aperture 24 includes a number of valve positioning indexing shoulders 26 located on the side walls of the aperture 24. The lid body 22 also includes a plurality of outlet ports 28 that are located adjacent to the periphery of the body for dispensing liquid or coffee therefrom as shown in FIG. 3.

The body 22 is configured with a peripheral raised lip 30 on the outside and is shaped with a centrally positioned recessed dome 32 on the top surface. The outlet ports 28 are aligned in a circle between the lip 30 and the dome 32 with the apex of the dome containing the centralized aperture 24. A valve seat 34 is formed into the bottom of the body 22 and provides a uniform sealing surface underneath.

Figure 5:
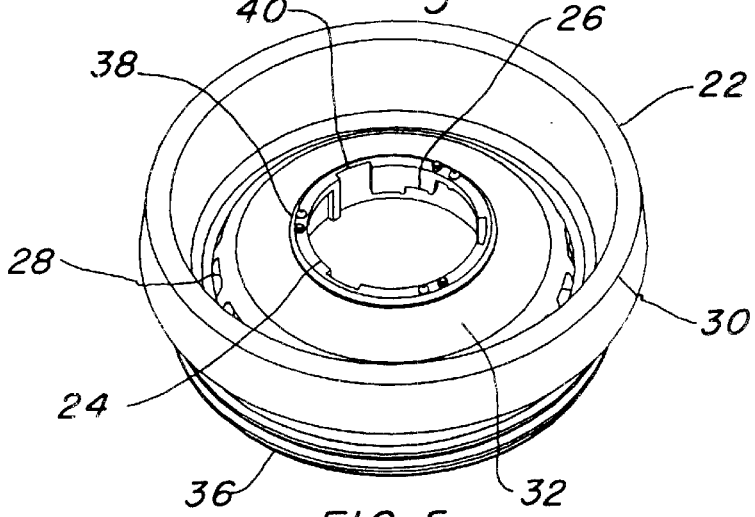
FIG. 5 is a partial isometric view of the coffee mug lid body of the preferred embodiment, completely removed from the invention for clarity.
Figure 6:
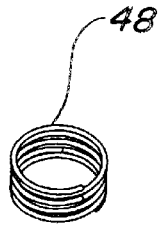
FIG. 6 is a partial isometric view of the compression spring of the preferred embodiment, completely removed from the invention for clarity.
Figure 7:
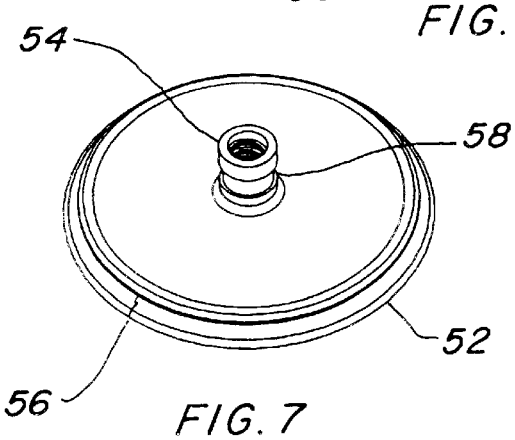
FIG. 7 is a partial isometric view of the valve plate of the preferred embodiment, completely removed from the invention for clarity.
Figure 8:
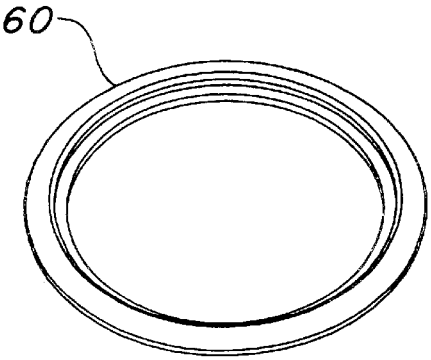
FIG. 8 is a partial isometric view of the valve seat gasket of the preferred embodiment, completely removed from the invention for clarity.
Figure 9:
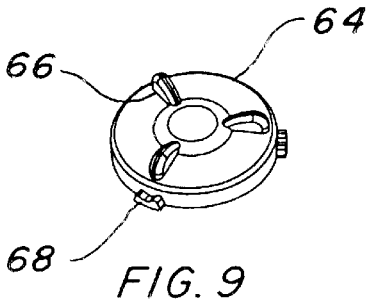
FIG. 9 is a partial isometric view of the finger twist knob of the preferred embodiment, completely removed from the invention for clarity.
Figure 10:
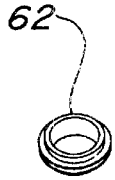
FIG. 10 is a partial isometric view of the push ring gasket of the preferred embodiment, completely removed from the invention for clarity.
Figure 11:
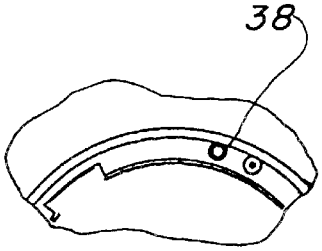
FIG. 11 is a fragmentary plan view of the top of the lid body illustrating the open/closed indicating symbols.

A plurality of threads 36 are formed around a lower side of the lid body 22 and provide a convenient interface with like threads on a conventional coffee mug. Indicia 38, preferably in the form of a raised circular symbol and a raised circular symbol with a dot in the middle, indicate the position of being open or closed. Other types and shapes of symbols or lettering may optionally be employed, in the language of use, for position indication. The lid body aperture 24 includes a plurality of attachment finger slots 40, as illustrated in FIG. 5, that are indented into the body 22.

A valve guide plate 42 is utilized to provide a stabilization and direction to the lids moving parts. The guide plate 42 is shown by itself in FIG. 12 and includes a push ring guide bore 44 in the middle. The guide plate 42 is disposed within a bottom portion of the centralized aperture 24 and an upstanding spring retaining boss 46 is integrally built into the guide plate 42 with the guide bore 44 forming the inside surface of the boss 46.

Figure 12:
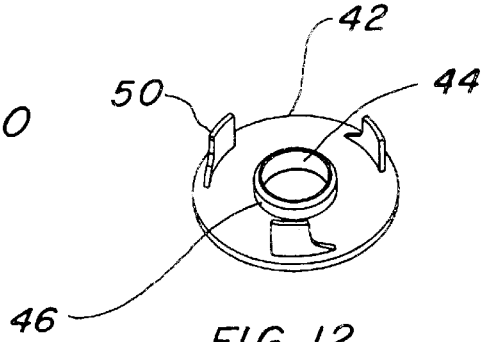
FIG. 12 is a partial isometric view of the valve guide plate of the preferred embodiment, completely removed from the invention for clarity.
Figure 13:
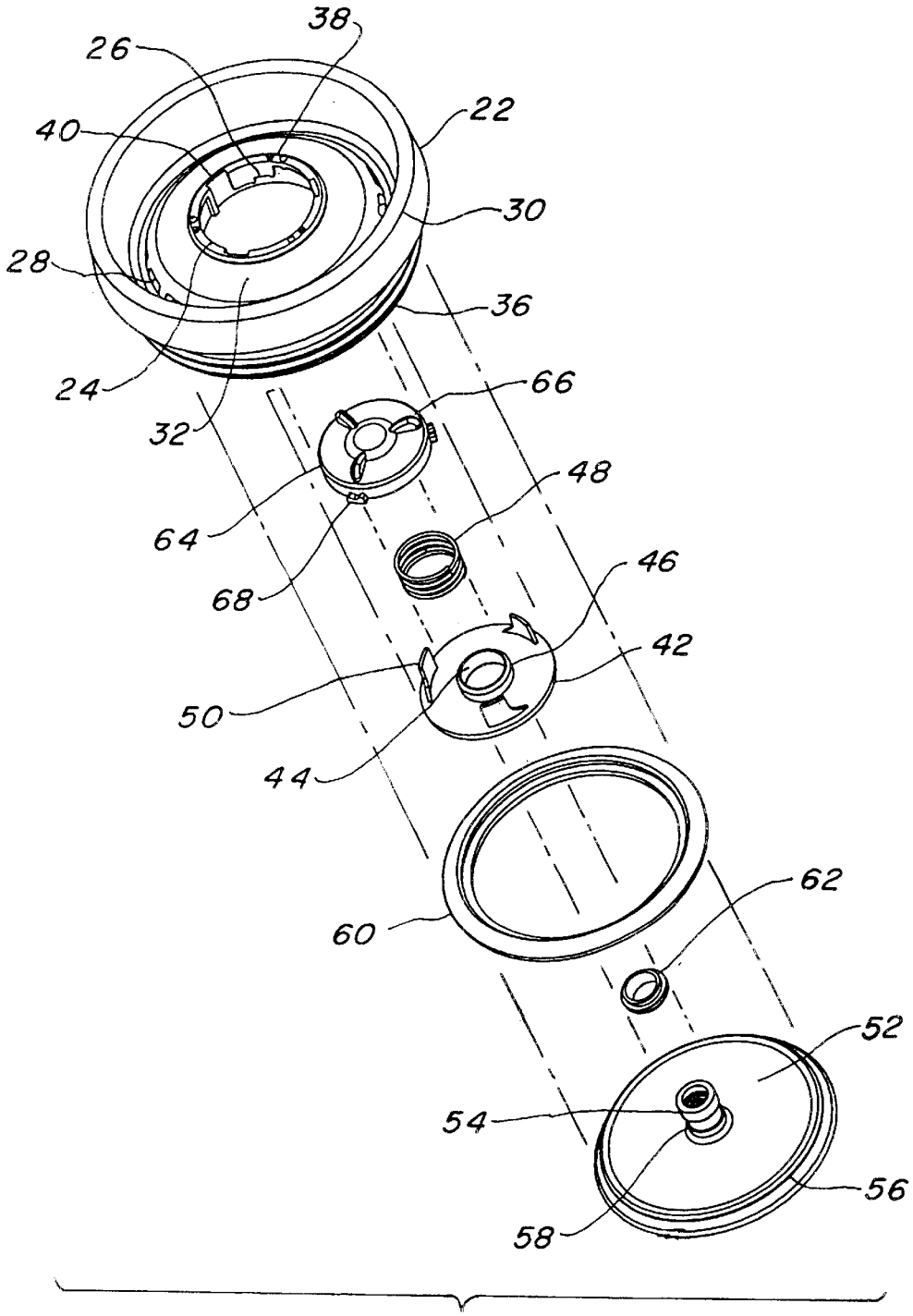
FIG. 13 is an exploded isometric view of the preferred embodiment.

The guide plate boss 46 has a compression spring 48 disposed upon the bosses outside diameter to provide the force for sealing liquid within the coffee mug when in the lid is in the closed position. The compression spring 48 is fabricated of stainless steel and is well known in the art and is readily available. The valve plate 42 includes a plurality of attachment fingers 50, preferably three, as shown in FIG. 12, with the fingers interfacing with the body finger slots 40 in the aperture 24 of the lid body 22.

A gasketed valve plate 52 has a push ring 54 that protrudes upwardly from the center of the valve plate 52. The push ring 54 is slideably positioned within the guide plate push ring guide bore 44 and centers the valve plate 52 within the coffee mug lid 20. The valve plate 52 has a valve seat gasket groove 56 on a bottom lower portion of the valve plate 52 and a push ring gasket groove 58 is located in the push ring 54. A valve seat gasket 60 is retained in the valve seat gasket groove 56 and a push ring gasket 62 is retained in the push ring gasket groove 58. The valve seat gasket 60 seals the valve plate 52 to the body 22 when coffee mug lid is in a closed position. The push ring gasket 62 seals the valve plate 52 to the guide plate 42 forming a leak proof joint when the lid is in the closed position.

The valve seat gasket 60 and the push ring gasket 62 may be formed of a resilient material including natural rubber, synthetic rubber and flexible thermoplastic, including silicone, neoprene, and viton or the like.

A spring loaded finger twist knob 64 is rotatably located within the top portion of the centralized aperture 24. The twist knob 64 includes a plurality of manual rotation tabs 66 protruding from the knobs top providing a gripping surface to rotate the twist knob 64 with ones fingers. Further the twist knob 64 has a plurality of outwardly protruding positioning lugs 68 interfacing with the lid body aperture indexing shoulders 26 for limiting and controlling rotational movement of the knob an also for holding the knob 64 in place in the aperture 24.

The lid body 22, valve guide plate 42, valve plate 52 and said finger twist knob 64 are formed of a thermoplastic such as of cellulose, phenolic, phenylene oxide, polycarbonate, polyester, polyethylene, polypropylene, polystyrene, acetyl, polyester, phenylene oxide, polymide or poly vinyl chloride.

In operation, the coffee mug lid 20 is screwed onto a conventional coffee mug and functions as follows: when the twist knob 64 is rotated within the indexing shoulders 26, the valve plate 42 is urged down, against spring compression, disengaging the valve plate 42 from the lid body 22 creating a flow path around the valve plate 42 and through the outlet ports 28. The opening of the flow path permits coffee, or the liquid within the mug, to be supplied to the user. When the twist knob 64 is rotatably reversed the valve plate 42 returns to its at rest position with gasketed securement of liquid, in a leak proof manner, within the mug.

It should be noted that when the lid 20 is assembled and the twist knob 64 is permanently attached to the valve plate 52, the spring 48 is compressed forcing continual intimate engagement of the valve seat gasket 60 to the valve seat 34 on the bottom of the lid body 22 effectively sealing the liquid in the mug. The seal is only broken when the finger twist knob 64 is rotated as indicated by the position of the rotation tabs 66 in relation to the indicia 38. It may be clearly seen that the operation is easy and obvious in its functional procedure.

While the invention has been described in complete detail and pictorially shown in the accompanying drawings, it is not to be limited to such details, since many changes and modifications may be made to the invention without departing from the spirit and scope thereof Hence, it is described to cover any and all modifications and forms which may come within the language and scope of the appended claims.

What is claimed is:

1. A leak proof coffee mug lid comprising, a lid body having a centralize aperture therethrough, with said aperture having valve positioning indexing shoulders within, and said lid body having a plurality of outlet ports adjacent to the body periphery for dispensing coffee therefrom, a valve guide plate having a push ring guide bore, disposed within a bottom portion of the centralized aperture, a gasketed valve plate, having a push ring protruding upwardly in a center thereof, with the push ring slideably positioned within the guide plate push ring guide bore, and a spring loaded finger twist knob rotatably located within a top portion of the centralized aperture, such that when the twist knob is rotated within the indexing in shoulders the valve plate is urged downwardly against spring compression disengaging the valve plate from the lid body creating a flow path around the valve plate and through the outlet ports, permitting coffee to be supplied to a user, and when the twist knob is rotatably reversed the valve plate returns to an at rest position with gasketed securement of coffee, in a leak proof manner, within a mug to which the lid may be attached.

2. The leak proof coffee mug lid as recited in claim 1 wherein said lid body further comprising a peripheral raised lip and a centrally positioned recessed dome, with the outlet ports aligned in a circle between the lip and the dome, also said dome containing the centralized aperture at an apex thereof.

3. The leak proof coffee mug lid as recited in claim 1 wherein said lid body further comprises a valve seat on said lid body bottom conforming to a valve plate configuration, providing a uniform sealing surface.

4. The leak proof coffee mug lid as recited in claim 1 wherein said lid body further comprising a plurality of threads around a lower side of the lid body for interfacing with like threads on a coffee mug.

5. The leak proof coffee mug lid as recited in claim 1 wherein said lid body further comprising a plurality of indicia adjacent to the lid body aperture, indicating the position of the valve plate.

6. The leak proof coffee mug lid as recited in claim 5 wherein said lid body indicia further comprising a raised circular symbol and a raised circular symbol with a dot in the middle.

7. The leak proof coffee mug lid as recited in claim 1 wherein said lid body aperture having a plurality of attachment finger slots indented into the body and said valve guide plate having a plurality of attachment fingers, with the fingers interfacing with the body finger slots.

8. The leak proof coffee mug lid as recited in claim 1 wherein said valve guide plate further comprising a spring retaining boss upstanding thereupon, with said guide bore forming an inside surface of the boss.

9. The leak proof coffee mug lid as recited in claim 8 wherein said valve guide plate boss further comprising a compression spring disposed upon said valve guide plate boss outside diameter, for sealing the valve plate to the body when the twist knob is rotated to a closed position.

10. The leak proof coffee mug lid as recited in claim 8 wherein said valve guide plate boss and said twist knob, also said valve plate and said body are permanently joined together after assembly of the leak proof coffee mug lid.

11. The leak proof coffee mug lid as recited in claim 10 wherein said valve guide plate boss to twist knob, and valve plate to body are permanently joined by ultrasonic welding.

12. The leak proof coffee mug lid as recited in claim 1 wherein said valve plate further having a valve seat gasket groove on a bottom lower portion of the valve plate and said valve plate further having a push ring gasket groove in the push ring.

13. The leak proof coffee mug lid as recited in claim 12 further comprising a valve seat gasket retained in the valve seat gasket groove and a push ring gasket retained in the push ring gasket groove.

14. The leak proof coffee mug lid as recited in claim 13 wherein said valve seat gasket and said push ring gasket are formed of a resilient material selected from the group consisting of, natural rubber, synthetic rubber and flexible thermoplastic, including silicone, neoprene, and viton.

15. The leak proof coffee mug lid as recited in claim 1 wherein said finger twist knob further comprising a plurality of manual rotation tabs protruding from the knobs top providing a gripping surface to rotate the twist knob with ones fingers.

16. The leak proof toffee mug lid as recited in claim 1 wherein said twist knob further comprising a plurality of outwardly protruding positioning lugs interfacing with the lid body aperture indexing shoulders for limiting and controlling rotational movement of the knob.

17. The leak proof coffee mug lid as recited in claim 1 wherein said lid body, valve guide plate, valve plate and said finger twist knob are formed of a thermoplastic selected from the group consisting of cellulose, phenolic, phenylene oxide, polycarbonate, polyester, polyethylene, polypropylene, polystyrene, acetyl, polyester, phenylene oxide, polymide and poly vinyl chloride.

18. A leak proof coffee mug lid comprising, a lid body having a centralize aperture therethrough, and a plurality of outlet ports adjacent to the body periphery for dispensing coffee therefrom, a valve guide plate, disposed within a bottom portion of the centralized aperture, a gasketed valve plate, positioned under the body, and a spring loaded finger twist knob located within a top portion of the centralized aperture, such that when the twist knob is rotated the valve plate is urged downwardly under spring tension disengaging the valve plate from the lid body creating a flow path around the valve plate and through the outlet ports, permitting coffee to be supplied to a user, and when the twist knob is rotatably reversed the valve plate returns by spring compression to an at rest position with gasketed securement of coffee, in a leak proof manner, within a mug to which the lid may be attached.

19. A leak proof coffee mug lid comprising, a lid body having a aperture therethrough, and a plurality of outlet ports adjacent to the body periphery for dispensing coffee therefrom, a valve guide plate, disposed within a bottom portion of the aperture, a valve plate, positioned under the body, and a finger twist knob located within a top portion of the aperture, such that when the twist knob is rotated the valve plate is urged downwardly disengaging the valve plate from the lid body creating a flow path around the valve plate and through the outlet ports, permitting a liquid to be supplied to a user, and when the twist knob is rotatably reversed the valve plate returns to an at rest position with securement of liquid, in a leak proof manner, within a mug on which the lid may be attached.

* * * * *